US005097296A

United States Patent [19]

Goto et al.

[11] Patent Number: 5,097,296

[45] Date of Patent: Mar. 17, 1992

[54] MULTICOLOR IMAGE FORMING APPARATUS USING CHARGERS WITH OPPOSITE POLARITY

[75] Inventors: Hiroshi Goto; Sanji Inagaki; Tetsuya Yamada; Masaaki Yamamoto; Shoichi Tsuge, all of Osaka, Japan

[73] Assignee: Minolta Camera Kabushiki Kaisha, Osaka, Japan

[21] Appl. No.: 410,490

[22] Filed: Sep. 21, 1989

[30] Foreign Application Priority Data

Sep. 22, 1988 [JP] Japan ..... 63-238270

[51] Int. Cl.[5] ..... G03G 15/01

[52] U.S. Cl. ..... 355/328; 355/225; 355/326

[58] Field of Search ..... 355/219, 220, 221, 223, 355/224, 225, 226, 227, 245, 326, 327, 328; 250/324, 325, 326; 430/45, 122

[56] References Cited

U.S. PATENT DOCUMENTS

| | | | |
|---|---|---|---|
| 4,562,130 | 12/1985 | Oka | 355/244 X |
| 4,794,062 | 12/1988 | Oka et al. | 355/268 X |
| 4,821,071 | 4/1989 | Oka et al. | 355/219 X |
| 4,984,021 | 1/1991 | Williams | 355/245 |
| 4,994,854 | 2/1991 | Miyamato | 355/225 X |

FOREIGN PATENT DOCUMENTS

| | | | |
|---|---|---|---|
| 53-115238 | 10/1978 | Japan . | |
| 55-38561 | 3/1980 | Japan . | |
| 0098672 | 4/1988 | Japan | 355/225 |

*Primary Examiner*—A. T. Grimley
*Assistant Examiner*—Christopher Horgan
*Attorney, Agent, or Firm*—Burns, Doane, Swecker & Mathis

[57] ABSTRACT

An image forming apparatus wherein a multicolored image of an original is formed in color on a sheet in one cycle of image forming operation. The apparatus comprises a plurality of developing devices which are filled with respective developers colored differently from each other and a scorotoron charger disposed between the developing devices for recharging on electrostatic latent image on a photosensitive member processed by the upstream developing device with the polarity opposite to the polarity charged beforehand. The developing device located upstream of the scorotron charger functions to develop the imaged portions including primary information which were charged with first potential. The scorotron charger recharges the electrostatic latent image with the opposite polarity, thereby lowering the potential of the other imaged portions including background information which were charged with second potential. The image portions charged with the second potential are developed in low density by the downstream developing device, portions with the second potential finely contrast with each other can be formed.

7 Claims, 3 Drawing Sheets

MULTICOLOR IMAGE FORMING APPARATUS USING CHARGERS WITH OPPOSITE POLARITY

BACKGROUND OF THE INVENTION

1. Field of the Invention

The present invention relates to an electrophotographic image forming apparatus, and more specifically, an image forming apparatus wherein a multicolored image of a multicolored original is formed on sheets in one cycle of image forming operation based on the electrophotographic processing.

2. Description of Related Art

Multicolored originals to be subjected to a copying operation are generally those which have black letters marked with a color marker and corrections in color ink. A variety of methods and apparatuses for copying a bicolored image of such an original on a sheet in one cycle of the image forming operation (including one cycle of a charging process, an exposing process and a transferring process) have been discussed and developed. For example, Japanese patent Laid Open Publication No. 55-38561 discloses a high-speed multicolor printing method. According to the publication, after an electrostatic latent image is formed having two values, a plurality of developing devices are impressed with respective developing bias voltages different from each other so that each portion of the latent image having a different value can be developed.

In a method for developing an electrostatic latent image having two values by applying different developing bias voltages, if the density is set high so that the marked portions are developed densely, the marked portions and lettered portions will be mixed with each other in the border portions. Because of this, the contrast of the letters and the mark will be weaken, and there will be a difficulty in reading the lettered portions packed with primary information. On the other hand, if the density is set low so that the marked portions are developed thinly corrected portions will be developed thinly, too, so that there will be a difficulty in reading the correction.

SUMMARY OF THE INVENTION

It is, therefore, an object of the present invention to attain a quality image where lettered portions and marked portions finely contrast with each other and corrected portions are copied clearly with use of an electrophotographic multicolored image forming apparatus for forming and developing an electrostatic latent image corresponding to a multicolored original on a photosensitive member and transferring the image on a sheet.

To attain the above-mentioned object, an electrophotographic image forming apparatus according to the present invention comprises a photosensitive member; means for charging said photosensitive member with specified polarity; means for forming an electrostatic latent image of a plurality of imaged portions which have different potential from each other and non-imaged portions with substantially lower potential on said photosensitive member; a plurality of developing devices disposed around said photosensitive member, which are filled with respective developers colored differently from each other; means for impressing said developing devices with respective developing bias voltages in accordance with the potential of the imaged portions; and means disposed between said developing devices for recharging said photosensitive member with the polarity opposite to that charged by said charging means. Preferably, said recharging means may be a scorotron charger. Further, its charging wire is impressed with a voltage with the polarity opposite to that charged by said charging means, and its grid is impressed with a voltage with the same polarity as that charged by charging means and a value lower than the potential of the imaged Portions processed by the upstream developing device and higher than the potential of the non-imaged portions.

A case of copying a bicolored original with use of the apparatus with the constitution above is hereinafter described step by step. Suppose the bicolored imaged portions to be formed of lettered-in-black portions having primary information, marked-in-red portions coloring some parts of the lettered-in-black portions and corrected-in-red portions. First, in an exposing process, a positive electrostatic latent image is formed having two potential values in accordance with the bicolored original image. The lettered-in-black portions remain potential which is almost as high as the surface potential initially charged, and the marked-in-red portions and the corrected-in-red portions have lower potential. A developing bias voltage which is effective only to the lettered-in-black portions with high potential being impressed on the first developing device, the lettered-in-black portions are developed by the first developing device. Next the electrostatic latent image whose some parts have been already developed is charged with the polarity opposite to the latent image by the scorotron charger. Thereby, the potential of the marked-in-red portions is slightly lowered. However the charge is not effective to the edge portions of them, and the potential of the edge portions is not lowered. Then, a developing bias voltage which is close to the lowered potential of the center portions of the marked-in-red portions being impressed on the second developing device, the marked-in-red portions and the corrected-in-red portions are developed by the second developing device. Thereby, the edge portions with high potential, that is, the outlines of the marked-in-red portions and the corrected-in-red portions are developed thickly, and the marked-in-red portions overlapping the lettered-in-black portions are developed thinly.

The toner image formed in this way is transferred onto a sheet and fixed thereon. Thus, in one cycle of image forming operation, a quality image whose lettered-in-black portions finely contrast with marked-in-red portions and whose corrected-in-red portions are clear is formed on a sheet.

BRIEF DESCRIPTION OF THE DRAWINGS

These and other objects and features of the present invention will become apparent from the following description taken in conjunction with the preferred embodiment thereof with reference to the accompanying drawings.

The drawings show an embodiment of an image forming apparatus according to the present invention.

DETAILED DESCRIPTION OF THE PREFERRED EMBODIMENT

An embodiment of the present invention is hereinafter described in reference to the accompanying drawings.

Figure 1:
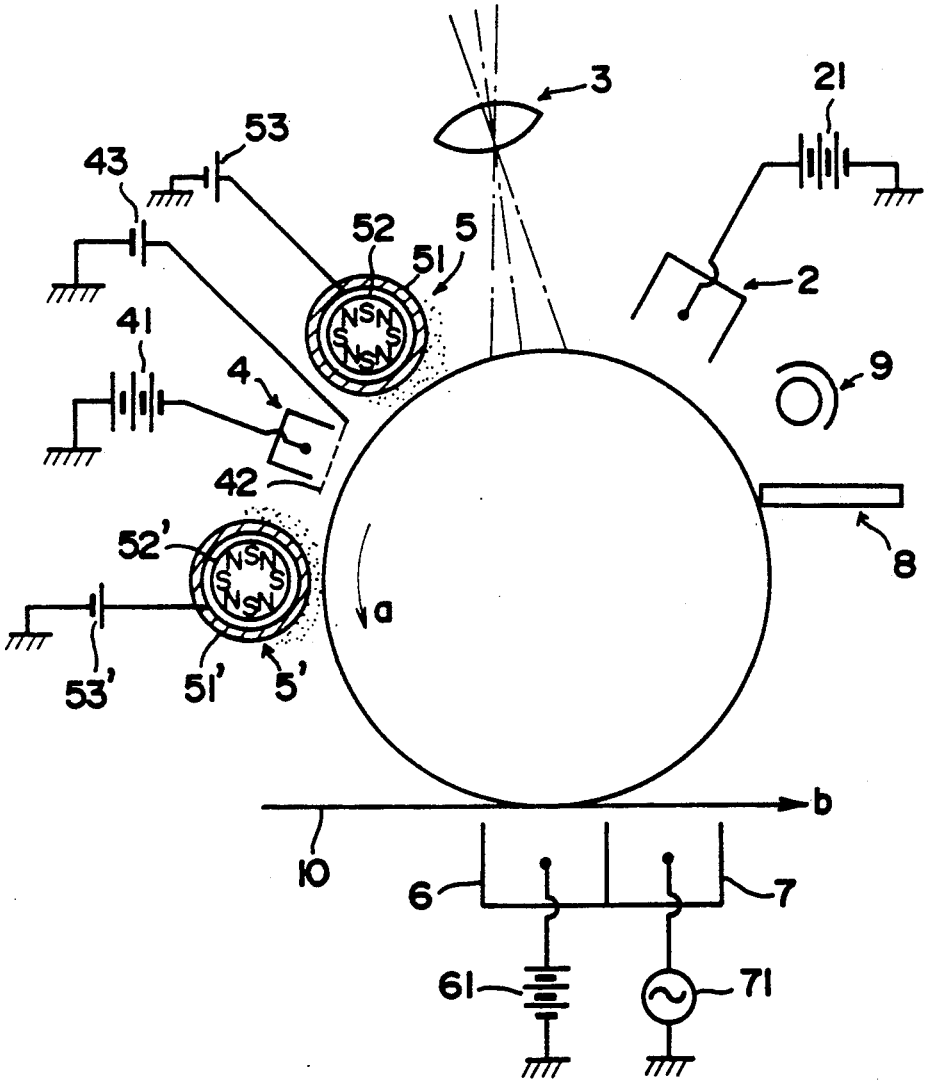
FIG. 1 is a schematic view of the apparatus showing its general constitution.

FIG. 1 is a schematic view of an electrophotographic copying machine which is an embodiment of the present invention. Numeral 1 is a conventional photosensitive drum, and it has a photosensitive layer on its circumferential surface and can be driven to rotate in the direction of the arrow a. Around the photosensitive drum 1, devices and members as explained below are disposed.

An electric charger 2 charges the photosensitive drum 1 with specified potential on the surface (first electric charge), and its charging wire is connected to a power source 21.

An image exposure device 3 works to form an electrostatic latent image of an original on the surface of the photosensitive drum 1 in the well-known slit exposure method, and it comprises an exposure lamp, a mirror, a lens, etc.

Developing devices 5 and 5' are according to the well-known magnetic brushing principle, and they comprise developing sleeves 51 and 51' respectively. The developing sleeves 51 and 51' incorporate respective magnet rollers 52 and 52' whose circumferential surfaces are polarized with N and S. The developing sleeves 51 and 51', which also function as developing electrodes, are connected to power sources 53 and 53' for impressing a developing bias respectively. The developer is a mixture of magnetic carriers and insulative toner. The carriers and the toner are charged with the opposite polarity to each other by the frictional electrification between them, and the insulative toner is charged so as to have the polarity opposite to that charged by the electric charger 2. In order to perform development in two colors, the first developing device 5 is filled with developer including black toner, and the second developing device 5' is filled with developer including red toner.

Further, non-contact development is preferable in the second developing process, otherwise there is a fear of scratching black toner which was stuck on the photosensitive drum 1 in the first developing process.

Between the two developing devices 51 and 51', a scorotron charger 4 functioning as means for forming an outline image is disposed. The scorotron charger 4 recharges the photosensitive drum 1 on the surface (second electric charge). Its charging wire is connected to a power source 41, and its grid 42 is connected to a power source 43. The power source 41 impresses the charging wire with a voltage with the polarity opposite to that charged by the electric charger 2. The grid 42 is impressed with a voltage by the power source 43 so as to have the same polarity as the voltage impressed on the electric charger 2. Further, the voltage to be impressed on the grid 42 in this moment have to be higher than the surface potential of the non-imaged portions of the electrostatic latent image.

A transfer charger 6 functions to form an electric field on the reverse side of a copying sheet 10 traveling in the direction of the arrow b so that a toner image formed on the photosensitive drum 1 by the developing devices 5 and 5' can be transferred onto the sheet 10. (The mechanism of forming a toner image will be described later.) The charging wire is impressed with a voltage by a power source 61 so as to have the polarity opposite to that of the insulative toner.

A separation charger 7 functions to form an ac electric field at a place where the sheet 10 passes immediately after the image transfer section so that the charge on the sheet 10 is erased, whereby the sheet 10 is removed from the surface of the photosensitive drum 1. The charging wire is impressed with an ac voltage by a power source 71.

A cleaning device 8 has a blade for removing the residual toner from the surface of the photosensitive drum 1.

An eraser lamp 9 removes the residual charge from the surface of the photosensitive drum 1 by an irradiation in order to make the Photosensitive drum 1 ready for the next copying operation.

The formation of a bicolored image by the above constituted copying machine is hereinafter described step by step referring to definite values of potential and so on. Further, the description is hereinafter given in connection with a case of using non-magnetic insulative toner.

(i) First Charging Process

The photosensitive drum 1 is charged with specified potential on the surface by the electric charger 2. In this embodiment, the surface potential is +500 V.

(ii) Exposing Process

Figure 2A:
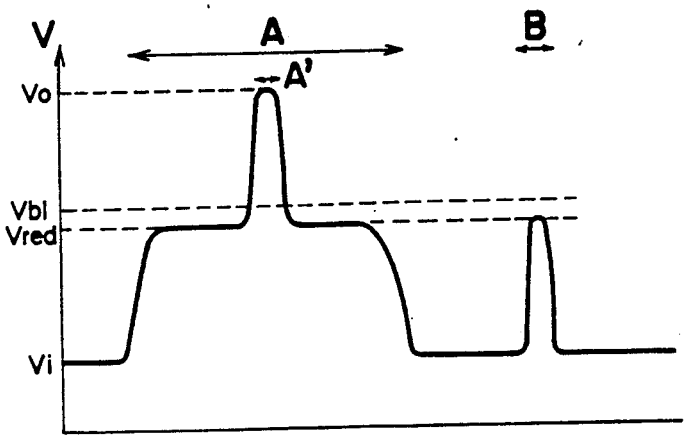
FIGS. 2*a*, 2*b* and 2*c* are graphs showing potential of an electrostatic latent image on a photosensitive member in a image forming process.

An original is subjected to a slit exposure, and the image is projected onto the surface of the photosensitive drum 1 with even potential. In this case, the original image is colored with red and black. So, an electrostatic latent image is formed on the photosensitive drum 1, as shown in FIG. 2*a*, has lettered-in-black portions A', marked-in-red portions A and corrected-in-red portions B. The surface potential (Vo) of the lettered-in-black portions A' remain +500 V, and the surface potential (Vred) of the marked-in-red portions A and the corrected-in-red portions B is lowered to +280 V. The surface potential (Vi) of the other portions, that is, non-imaged potions is lowered to +40 V.

(iii) First Developing Process

In this process, the electrostatic latent image with two values of surface potential, which was formed in said exposing process, is developed with black toner by the first developing device 5. In this moment, the developing sleeve 51 is impressed with a developing bias voltage (Vb1) of +300 V, which is lower than the surface potential (Vo) of the lettered-in-black portions A' and higher than the surface potential (Vred) of the marked-in-red portions A and the corrected-in-red portions B, by the power source 53. Thereby, the black loner Is stuck only on the lettered-in-black portions A' with the potential (Vo).

Figure 2B:
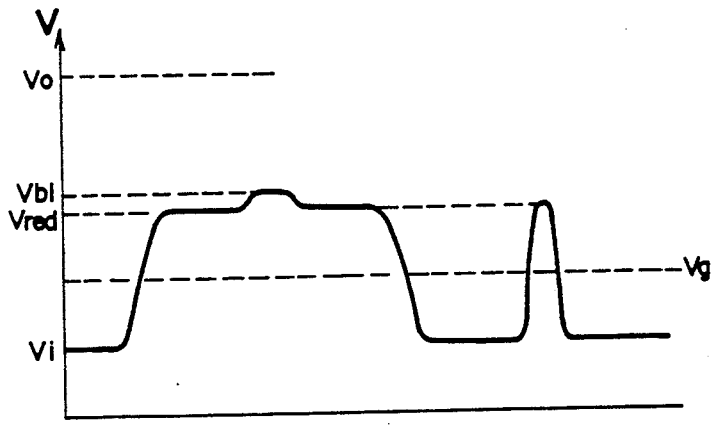
Figure 3A:
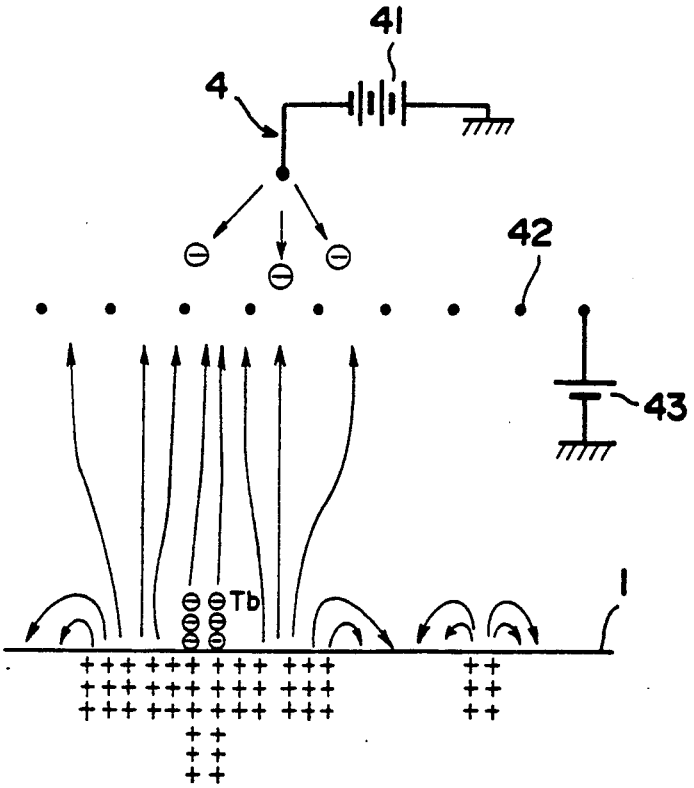
FIGS. 3*a* and 3*b* are explanatory charts showing electric lines of force, of charge and adhesion of toner.

FIGS. 2*b* and 3*a* show potential of the electrostatic latent image and adhesion of toner at the time of completing the first developing process. Character Tb in FIG. 3*a* show black toner stuck on the photosensitive drum 1.

(iv) Second Charging process Outline Image Forming Process)

The photosensitive drum 1 holding the electrostatic latent image whose Potential distribution is as shown in FIG. 2*b* is charged with the polarity opposite to that of the electrostatic latent image by the scorotron charger 4 which is impressed with a voltage of −5 kV by the power source 41. The grid 42 is impressed with a voltage (Vg) of +150 V which is lower than the surface potential (Vred) of the marked-in-red portions A and the corrected-in-red portions B and higher than the surface potential (Vi) of the non-imaged portions.

At that time, electric force as shown by the arrows in FIG. 3*a* is formed between the surface of the photosensitive drum 1 and the grid 42. The electric lines of force around the edge portions of the electrostatic latent image do not stretch toward the grid 42 but curve outward of the latent image. Negative ions produced by the scorotron charger 4 travel to the photosensitive drum 1 along the electric lines of force, and the negative ions which reached the surface of the photosensitive drum 1 lower the surface potential to almost the grid voltage (Vg). Thereby, the surface potential of the marked-in-red portions A is lowered to almost the voltage (Vg) except for the edge portions. In portions on which the black toner Tb is stuck, the negative ions give negative charge to the black toner Tb, so that the value of the charge on the black toner Tb is raised.

Figure 2C:
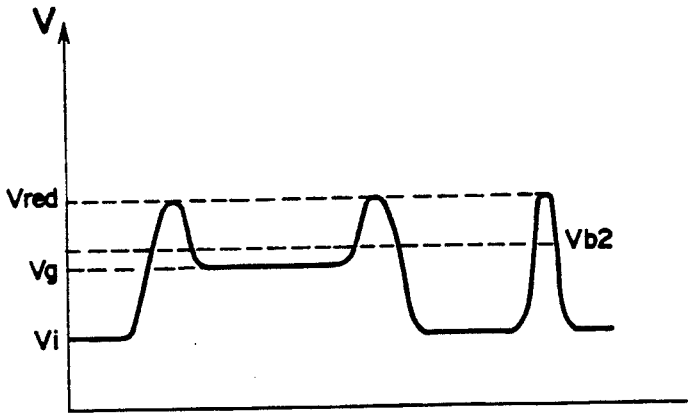

Thus, the potential distribution of the photosensitive drum 1 at the time of completing this process is shown by FIG. 2*c*. The non-imaged portions remain having the low potential (Vi), about +40 V. The outlines of the marked-in-red portions A, which are formed inside the edges with almost the same width as letters in the corrected-in-red portions B, and the corrected-in-red portions B have high potential (Vred), about +280 V. The surface potential of the center portions of the marked-in-red portions A including the portions on which the black toner is stuck has been lowered to almost the grid voltage (Vg), +150 V.

Further, the value of the charge on the latent image with the opposite polarity provided in this process may be higher or lower.

(v) Second Developing process

In this process, the electrostatic latent image processed in said second charging process is developed with red toner by the second developing device 5'. Regarding a developing bias voltage (Vb2) to be impressed on the developing sleeve 51' by the power source 53', the following two cases should be considered separately.

(1) $Vg \leqq Vb2 << Vred$

The grid voltage (Vg) is +150 V, and the potential (Vred) of the outlines of the marked-in-red portions A and the corrected-in-red portions B is +280 V. The impressed developing bias voltage (Vb2) is +170 V. In this case, the outlines of the marked-in-red portions A are comparatively strong, so that the lettered-in-black portions A' are enclosed with the red outlines (Refer to FIG. 3*b*). On the other hand, the red toner Tr is not stuck on the corrected-in red portions B so much. Accordingly, in this case, it is preferred to use bright red toner.

(2) $Vi < Vb2 \leqq Vg$

Figure 3B:
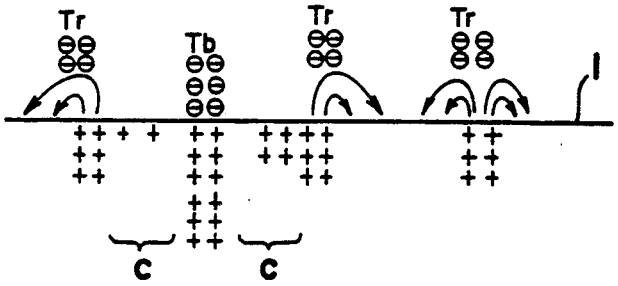

Concretely, the impressed developing bias voltage (Vb2) is +80 V. In this case, all the marked-in-red portions A including the portions C in FIG. 3*b* are developed in red, but all the portions other than the outlines are stuck with less toner because of the lower potential. Accordingly, the marked-in-red portions A are on the whole thin, so that the marked-in-red portions A and the lettered-in-black portions A' are never mixed with each other. Therefore, the black letters can be read without interruption of red mark. On the other hand, the corrected-in-red portions B are developed clearly.

Thus, in the exposing process, an electrostatic latent image is formed, two values of potential being distributed. Then, through the subsequent processes, the electrostatic latent image is colored with black and red so that the lettered-in-black portions including primary information and the marked-in-red portions emphasizing some parts of the lettered-in-black portions can keep a fine contrast with each other and that the corrected-in-red portions can be strong enough. The transfer charger 6 discharges electricity with negative polarity, and thereby the toner is transferred onto the sheet 10. Thereafter, the image is fixed on the sheet by a fixing device not shown in the drawings.

Although the present invention has been described in connection with the preferred embodiment thereof, it is to be noted that various changes and modifications are apparent to those who are skilled in the art. Such changes and modifications are to be understood as included within the scope of the present invention as defined by the appended claims, unless they depart therefrom.

Especially, in the embodiment above, the present invention has been described in connection with a bicolor image forming apparatus wherein an electrostatic latent image is formed after an original colored with black and red so as to have two values of potential. However, even if an original has two colors other than black and red, the present invention can be applied to form an electrostatic latent image with two values of surface potential in accordance with the colors. Also, if a color filter is used in consideration of the spectral sensitivity characteristic of the photosensitive layer, the present invention can be applied to make a copy of an original with any two colors.

Further, each of the potential (Vo), (Vred), (Vg), (Vb1) and (Vb2) is just an example, and each potential can be changed depending on conditions, especially, type of photosensitive layer and toner.

What is claimed is:

1. An electrophotographic image forming apparatus comprising:

a photosensitive member;

means for charging said photosensitive member with a specified polarity;

means for forming an electrostatic latent image of a plurality of image portions with different potential from each other and non-image portions with substantially lower potential on said photosensitive member;

a plurality of developing devices disposed around said photosensitive member, which are filled with different colored developers;

means for impressing said developing devices with respective developing bias voltages in accordance with the potential of the image portions; and means disposed between said developing devices for recharging said photosensitive member with a polarity opposite to that used by said first charging means so that the surface potential of a center portion of each image area will be reduced to a value which is still higher than the surface potential of said non-image portions.

2. An electrophotographic image forming apparatus as claimed in claim 1, wherein said recharging means comprises a scorotron charger whose charging wire is impressed with a voltage with the polarity opposite to that charged by said charging means and whose grid is impressed with a voltage with the same polarity as that charged by said charging means and a value lower than the potential of the image portions processed by the upstream developing device and higher than the potential of the non-image portions.

3. An electrophotographic image forming apparatus as claimed in claim 1, wherein said latent image forming means comprises a unit for exposing a bicolored original.

4. An electrophotographic image forming apparatus comprising:

a photosensitive member which is driven to rotate in one direction at a specified speed;

means for charging said photosensitive member with specified polarity;

means for forming an electrostatic latent image on said photosensitive member, two values of potential being distributed among the image portions, by exposing a bi-colored original;

a plurality of developing devices disposed around said photosensitive member along the rotating direction, which are filled with different colored developers;

means for impressing each of said developing devices with a developing bias voltage depending on the potential of the image portions which have two values; and a scorotron charger disposed between said developing devices for recharging the electrostatic latent image on said photosensitive member, which passed through the upstream developing device, with a polarity opposite to that used by said first charging means so that the surface potential of a center portion of each image area will be reduced to a value which is still higher than the surface potential of a non-image portion.

5. An electrophotographic image forming apparatus as claimed in claim 4, wherein the charging wire of said recharging scorotron charger is impressed with a voltage with the polarity opposite to that charged by said charging means, and the grid is impressed with a voltage with the same polarity as that charged by said charging means and a value lower than the potential of the image portions processed by the upstream developing device and higher than the potential of non-image portions.

6. An electrophotographic image forming apparatus as claimed in claim 5, wherein the developing bias voltage to be impressed on the developing device located downstream of said scorotron charger is lower than the potential of the image portions processed by the upstream developing device and higher than a voltage to be impressed on the grid.

7. An electrophotographic image forming apparatus as claimed in claim 5, wherein the developing bias voltage to be impressed on the developing device located downstream of said scorotron charger is lower than a voltage to be impressed on the grid and higher than the potential of the non-image portions.

* * * * *